US006047228A

United States Patent [19]

Stone et al.

[11] Patent Number: 6,047,228

[45] **Date of Patent: *Apr. 4, 2000**

[54] METHOD AND APPARATUS FOR LIMITING THE CONTROL OF AN IMPLEMENT OF A WORK MACHINE

[75] Inventors: Robert E. Stone, Metamora; Ricky D. Vance, Washington, both of Ill.

[73] Assignee: Caterpillar Inc., Peoria, Ill.

[ * ] Notice: This patent is subject to a terminal disclaimer.

[21] Appl. No.: 08/994,161

[22] Filed: Dec. 19, 1997

Related U.S. Application Data

[63] Continuation-in-part of application No. 08/668,886, Jun. 24, 1996, Pat. No. 5,701,793.

[51] Int. Cl.[7] ..... E02F 3/34

[52] U.S. Cl. ..... 701/50; 414/685; 37/414

[58] Field of Search ..... 414/699, 700, 414/701, 680, 685, 800, 815; 701/50; 37/348, 414

[56] References Cited

U.S. PATENT DOCUMENTS

| | | | |
|---|---|---|---|
| 4,625,622 | 12/1986 | Gunda et al. | 91/36 |
| 4,844,685 | 7/1989 | Sagaser | 414/700 |
| 5,065,326 | 11/1991 | Sahm | 414/699 |
| 5,189,940 | 3/1993 | Hosseini et al. | 91/361 |
| 5,333,533 | 8/1994 | Hosseini | 91/361 |
| 5,511,458 | 4/1996 | Kamata et al. | 91/361 |
| 5,537,818 | 7/1996 | Hosseini et al. | 60/327 |
| 5,701,793 | 12/1997 | Gardner et al. | 91/361 |

*Primary Examiner*—Donald W. Underwood
*Attorney, Agent, or Firm*—Byron G. Buck, II

[57] ABSTRACT

An apparatus for limiting the control of a work implement is disclosed. The implement is connected to a work machine and is moveable in response to operation of a hydraulic cylinder. The apparatus includes an operator controlled joystick. A joystick position sensor senses the position of the joystick and responsively generates an operator command signal. An implement position sensor senses the position of the work implement and responsively produces an implement position signal. A microprocessor based controller receives the implement position and operator command signals, modifies the operator command signal, and produces an electrical valve signal in response to the modified operator command signal. An electrohydraulic valve receives the electrical valve signal, and controllably provides hydraulic fluid flow to the hydraulic cylinder in response to a magnitude of the electrical valve signal.

2 Claims, 4 Drawing Sheets

METHOD AND APPARATUS FOR LIMITING THE CONTROL OF AN IMPLEMENT OF A WORK MACHINE

This application is a continuation-in-part of U.S. application Ser. No. 08/668,886, now U.S. Pat. No. 5,701,793, filed Jun. 24, 1996, entitled "Method and Apparatus for Controlling an Implement of a Work Machine".

TECHNICAL FIELD

This invention relates generally to a method and apparatus for limiting the movement of a work implement of a work machine and, more particularly, to an apparatus and method that limits the movement of the work implement based on the work implement position and operator command.

BACKGROUND ART

Work machines such as wheel type loaders include work implements capable of being moved through a number of positions during a work cycle. Such implements typically include buckets, forks, and other material handling apparatus. The typical work cycle associated with a bucket includes sequentially positioning the bucket and associated lift arm in a digging position for filling the bucket with material, a carrying position, a raised position, and a dumping position for removing material from the bucket.

Control levers are mounted at the operator's station and are connected to an electrohydraulic circuit for moving the bucket and/or lift arms. The operator must manually move the control levers to open and close hydraulic valves that direct pressurized fluid to hydraulic cylinders which in turn cause the implement to move. For example, when the lift arms are to be raised, the operator moves the control lever associated with the lift arm hydraulic circuit to a position at which a hydraulic valve causes pressurized fluid to flow to the head end of a lift cylinder, thus causing the lift arms to rise. When the control lever returns to a neutral position, the hydraulic valve closes and pressurized fluid no longer flows to the lift cylinder.

In normal operation, the work implement is often abruptly started or brought to an abrupt stop after performing a desired work cycle function, which results in rapid changes in velocity and acceleration of the bucket and/or lift arm, machine, and operator. This can occur, for example, when the implement is moved to the end of its desired range of motion. The geometric relationship between the linear movement of the tilt or lift cylinders and the corresponding angular movement of the bucket or lift arm can produce operator discomfort as a result of the rapid changes in velocity and acceleration. The forces absorbed by the linkage assembly and the associated hydraulic circuitry may result in increased maintenance and accelerated failure of the associated parts. Another potential result of the geometric relationship is excessive angular rotation of the lift arm or bucket near some linear cylinder positions which may result in poor performance.

Stresses are also produced when the vehicle is lowering a load and operator quickly closes the associated hydraulic valve. The inertia of the load and implement exerts forces on the lift arm assembly and hydraulic system when the associated hydraulic valve is quickly closed and the motion of the lift arms is abruptly stopped. Such stops cause increased wear on the vehicles and reduce operator comfort. In some situations, the rear of the machine can even be raised off of the ground.

Further, prior methods and apparatus have suffered from inconsistent control of rate of motion and stopping position.

This inconsistent control is believed to be a result of controlling solely on velocity or by scaling the operator command signal.

The present invention is directed to overcoming one or more of the problems as set forth above.

DISCLOSURE OF THE INVENTION

In one aspect of the present invention, an apparatus for controllably moving a work implement is disclosed. The implement is connected to a work machine and is moveable in response to operation of a hydraulic cylinder. The apparatus includes an operator controlled joystick. A joystick position sensor senses the position of the joystick and responsively generates an operator command signal. An implement position sensor senses the position of the hydraulic cylinder and responsively produces an implement position signal. A microprocessor based controller receives the implement position and operator command signals, modifies the operator command signal, and produces an electrical valve signal in response to the modified operator command signal. An electrohydraulic valve receives the electrical valve signal, and controllably provides hydraulic fluid flow to the hydraulic cylinder in response to a magnitude of the electrical valve signal.

BRIEF DESCRIPTION OF THE DRAWINGS

For a better understanding of the present invention, reference may be made to the accompanying drawings in which.

BEST MODE FOR CARRYING OUT THE INVENTION

Figure 1:
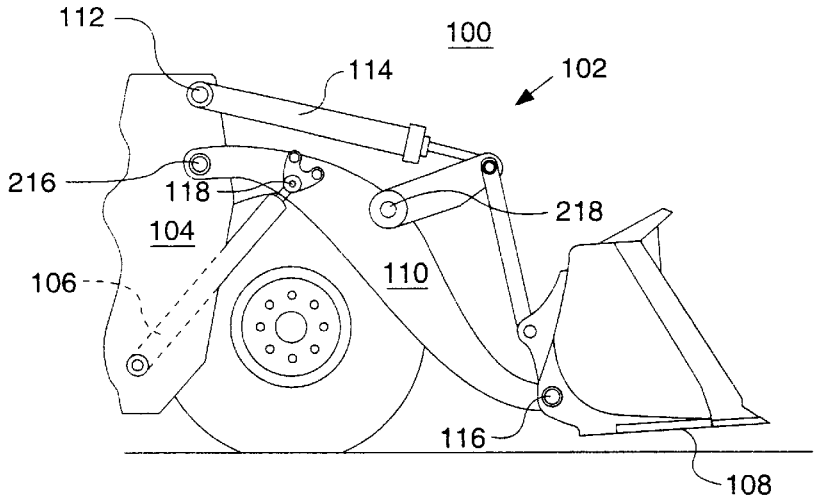
FIG. 1 is a side view of a forward portion of a loader machine or wheel type loader.

In FIG. 1, an implement control system is generally represented by the element number 100. FIG. 1 shows a forward portion of a wheel type loader machine 104 having a payload carrier in the form of a bucket 108. Although the present invention is described in relation to a wheel type loader machine, the present invention is equally applicable to many earth working machines such as track type loaders, hydraulic excavators, and other machines having similar loading implements. The bucket 108 is connected to a lift arm assembly or boom 110, which is pivotally actuated by two hydraulic lift actuators or cylinders 106 (only one of which is shown) about a boom pivot pin 112 that is attached to the machine frame. A boom load bearing pivot pin 118 is attached to the boom 110 and the lift cylinders 106. The bucket 108 is tilted by a bucket tilt actuator or cylinder 114 about a tilt pivot pin 116.

Figure 2:
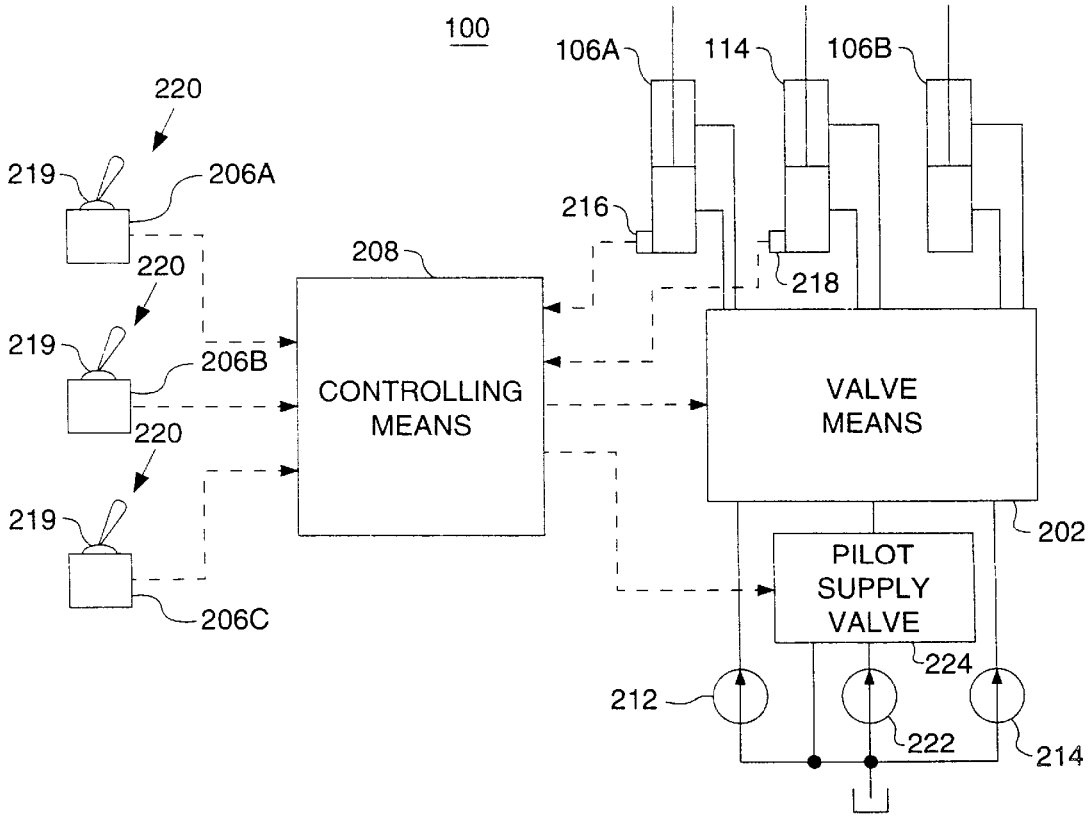
FIG. 2 is a block diagram of an electrohydraulic control system of the loader machine.

With reference to FIG. 2, the implement control system 100 as applied to a wheel type loader is diagrammatically illustrated. The implement control system is adapted to sense a plurality of inputs and responsively produce output signals which are delivered to various actuators in the control system. Preferably, the implement control system includes a microprocessor based controller 208. Preferably a Motorola MC68336 is used in the electronic control system. However, other known microprocessors could be readily and easily used without deviating from the scope of the present invention.

First, second, and third joysticks 206A,206B,206C provide operator control over the work implement 102. The joysticks include a control lever 219 that has movement along a single axis. However, in addition to movement along a first axis (horizontal), the control lever 219 may also move along a second axis which is perpendicular to the horizontal axis. The first joystick 206A controls the lifting operation of the boom 110. The second joystick 206B controls the tilting operation of the bucket 108. The third joystick 206C controls an auxiliary function, such as operation of a special work tool.

A joystick position sensor 220 senses the position of the joystick control lever 219 and responsively generates an electrical operator command signal. The electrical signal is delivered to an input of the controller 208. The joystick position sensor 220 preferably includes a rotary potentiometer which produces a pulse width modulated signal in response to the pivotal position of the control lever; however, any sensor that is capable of producing an electrical signal in response to the pivotal position of the control lever would be operable with the instant invention.

An implement position sensor 216,218 senses the position of the work implement 102 with respect to the work machine 104 and responsively produces a plurality of implement position signals. In the preferred embodiment, the position sensor 216,218 includes a lift position sensor 216 for sensing the elevational position of the boom 110 and a tilt position sensor 218 for sensing the pivotal position of the bucket 108.

In one embodiment, the lift and tilt position sensors 216,218 include rotary potentiometers. The rotary potentiometers produce pulse width modulated signals in response to the angular position of the boom 110 with respect to the vehicle and the bucket 108 with respect to the boom 110. The angular position of the boom is a function of the lift cylinder extension 106A,B, while the angular position of the bucket 108 is a function of both the tilt and lift cylinder extensions 114,106A,B. The function of the sensors 216,218 can readily be any other sensor which are capable of measuring, either directly or indirectly, the relative extension of a hydraulic cylinder. For example, the potentiometers could be replaced with radio frequency (RF) sensors disposed within the hydraulic cylinders.

A valve 202 is responsive to electrical signals produced by the controller and provides hydraulic fluid flow to the hydraulic cylinders 106A,B,114.

In the preferred embodiment, the valve 202 includes four main valves (two main valves for the lift cylinders and two main valves for the tilt cylinder) and eight HYDRAC valves (two HYDRAC valves for each main valve). The main valves direct pressured fluid to the cylinders 106A,B,114 and the HYDRAC valves direct pilot fluid flow to the main valves. Each HYDRAC valve is electrically connected to the controller 208. An exemplary HYDRAC valve is disclosed in U.S. Pat. No. 5,366,202 issued on Nov. 22, 1994 to Stephen V. Lunzman, which is hereby incorporated by reference. Two main pumps 212,214 are used to supply hydraulic fluid to the main spools, while a pilot pump 222 is used to supply hydraulic fluid to the HYDRAC valves. An on/off solenoid valve and pressure relief valve 224 are included to control pilot fluid flow to the HYDRAC valves.

As stated above, a pair of main valves are included for each of the tilt cylinder and lift cylinder pair. It is therefore desirable to move each main valve spool of the pair sequentially, rather than simultaneously, in order to provide desirable velocity and pressure modulation characteristics.

The present invention is directed toward determining an electrical valve signal magnitude to accurately control the work implement movement. The controller 208 is preferably associated with RAM and ROM modules that store software programs to carry out certain features of the present invention. Further, the RAM and ROM modules store a plurality of look-up tables that are used to determine the electrical valve signal magnitude. The controller 208 receives the implement position and operator command signals, modifies the operator command signal, and produces an electrical valve signal having a magnitude that is responsive to the modified operator command signal. The valve 202 receives the electrical valve signal, and controllably provides hydraulic fluid flow to the respective hydraulic cylinder in response to a magnitude of the electrical valve signal.

Figure 3:
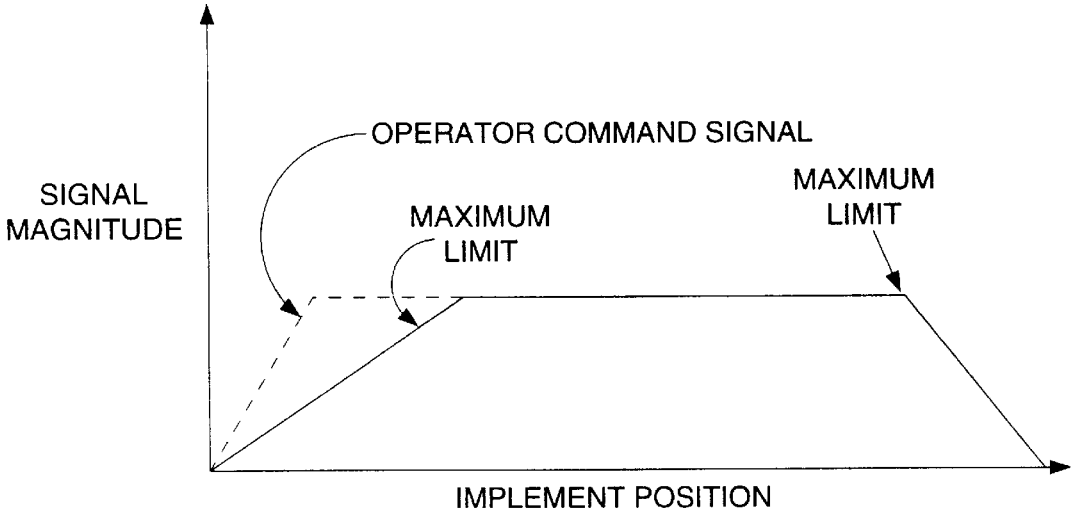
FIG. 3 shows a graph illustrating an operator command signal and an electrical valve signal over time.

The magnitude of the electrical valve signal is determined by comparing a predetermined maximum limit value with the magnitude of the operator command signal and selecting the lesser value. The predetermined maximum limit value is preferably a function of the implement position. For example, the operator command signal may have a value ranging from 0 to 100%. This aspect of limiting results in a reduction in the maximum rate (of the work implement movement) that the operator may command, and a reduction in the overall maximum velocity (of the work implement movement) that the operator may command. This is shown by the graph illustrated in FIG. 3. The operator command signal is shown in the dashed line, and the maximum limit values and the electrical valve signal is shown in the solid line.

Because the implement position signals are a function of the position of the respective hydraulic cylinders 106,114, the implement position signals are indicative of the amount of the respective hydraulic cylinder extension. Thus, the RAM and ROM modules store a plurality of look-up tables, each having a plurality of values that correspond to a plurality of hydraulic cylinder positions. Each look-up table corresponds to a work function that is used to control the work implement. The work functions include a lift and lower function which extends and retracts the lift hydraulic cylinders 106A,B to control the bucket height, and a dump and rack function which extends and retracts the tilt cylinder 114 to control the bucket attitude. The work function look-up tables are shown with respect to FIGS. 4–7. The number of values stored in memory is dependent upon the desired precision of the system. Interpolation may be used to determine the actual value in the event that the measured and calculated values fall between the discrete values stored in memory. The table values are based from simulation and analysis of empirical data.

Accordingly, the controller 208 determines the instant work function and selects the appropriate look-up table. Then based on the corresponding cylinder positions, the controller 208 selects a value from the look-up table and limits the operator command signal based on the selected value to control the work implement 102 at the lowest desired rate and velocity.

Figure 4:
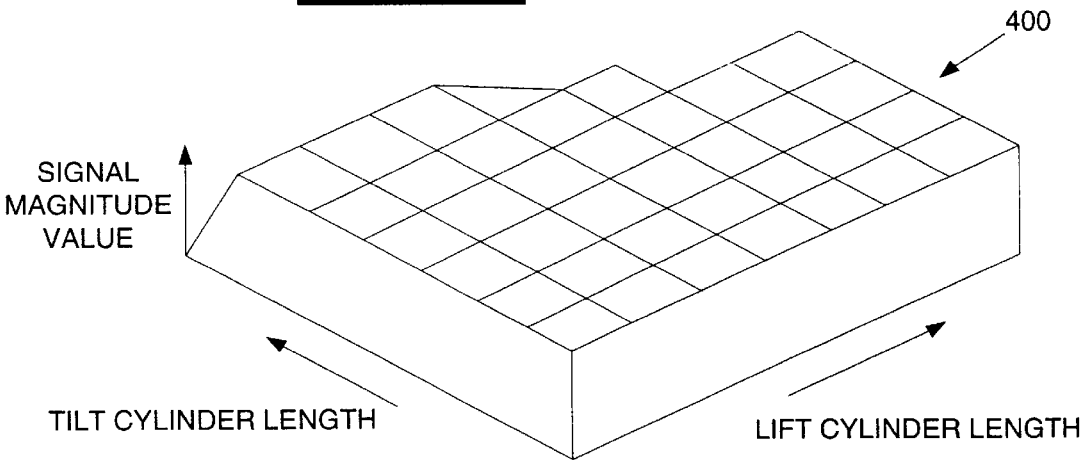
FIG. 4 represents a software look-up table associated with a dumping function.

Referring to FIG. 4, the dumping look-up table 400, which controls the pivoting of the bucket 108 to a desired maximum dumping angle, is shown. The dumping look-up table 400 stores a plurality of limiting values that correspond to the position of the lift and the tilt cylinders 106,114. The limiting values are chosen to limit the velocity or pivotal movement of the bucket 108, as the bucket approaches the desired maximum dumping angle. This is referred to as kinematic inversion. Thus, the limiting values provide for a velocity limiting effect when the tilt or lift cylinder approaches an extreme kinematic gain region near the desired maximum dump angle; thereby, reducing the "jerk" felt by the operator and reducing the forces within the cylinders.

Note, a kinematic gain region is defined as the ratio of the rotational displacement of the boom 110 or bucket 108 over the corresponding linear displacement of the associated lift or tilt cylinders 106,114. An extreme kinematic gain region is associated with those gain values that produce undesirable velocities or accelerations.

Further, the dumping look-up table provides for an electronic stop, i.e., the limiting values are chosen to stop the pivotal movement of the bucket 108 prior to the bucket 108 reaching the physical maximum dump angle. Consequently, the bucket movement can stop prior to engaging the mechanical stops (which are associated with infinite kinematic gains) in order to provide for structural protection of the work implement.

Figure 5:
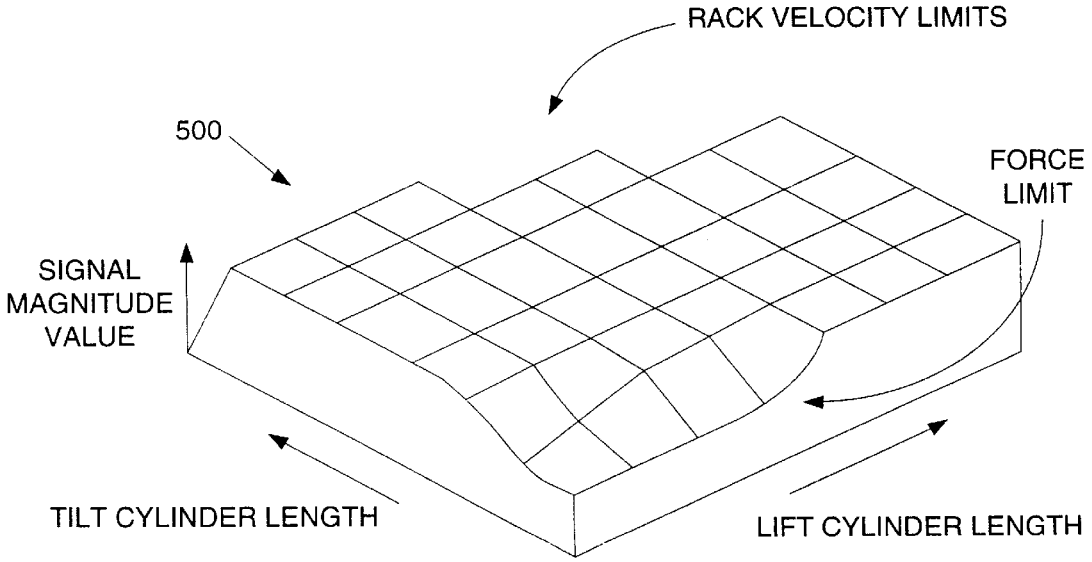
FIG. 5 represents a software look-up table associated with a racking function.

Referring now to FIG. 5, the racking look-up table 500, which controls the pivoting of the bucket 108 to a maximum racking angle, is shown. The racking look-up table 500 stores a plurality of limiting values that correspond to the position of the lift and the tilt cylinders 106,114. The limiting values are chosen to gradually increase the pivotal movement or velocity limit of the bucket 108 as the bucket is moved from the maximum dump angle to the desired maximum rack angle. Thus, as the bucket moves from the desired maximum dump angle, the limiting values gradually increase to allow the bucket movement to proportionally increase in order to provide for greater controllability of the racking function.

Further, the limiting values are chosen to reduce the hydraulic forces associated with the work implement being in a "fold-up" position, i.e., where the bucket is positioned at a desired maximum rack angle and when the boom is positioned at or near ground level. Thus, when the work implement is at the "fold-up" position, the limiting values are greatly reduced in order to reduce the electrical valve signal magnitude so that operator is prevented from further commanding a full rack command; thereby, preventing high hydraulic cylinder forces.

Figure 6:
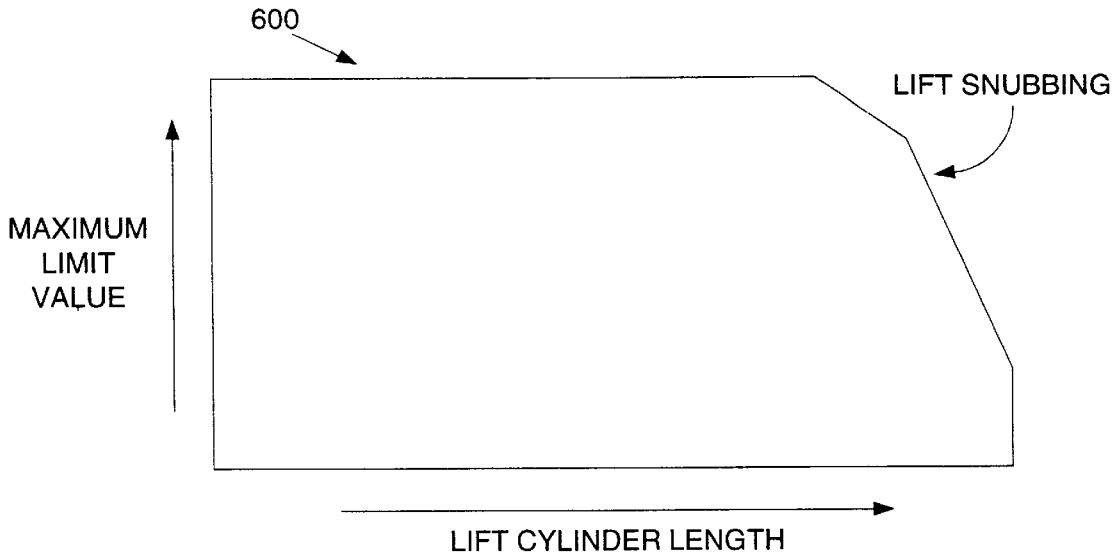
FIG. 6 represents a software look-up table associated with a lifting function.

Referring to FIG. 6, the lifting look-up table 600, which controls the lifting of the boom 110 to a desired maximum height, is shown. The lifting look-up table 600 stores a plurality of limiting values that correspond to the position of the lift cylinders 106A,B. The limiting values are chosen to limit the velocity or pivotal movement of the boom 110, as the boom approaches an extreme kinematic gain region near the desired maximum height. This is additionally referred to as kinematic inversion. Thus, the limiting values provide for a velocity limiting effect when the lift cylinders 106A,B approach the desired maximum height; thereby, reducing the "jerk" felt by the operator and reducing the forces within the cylinders.

Figure 7:
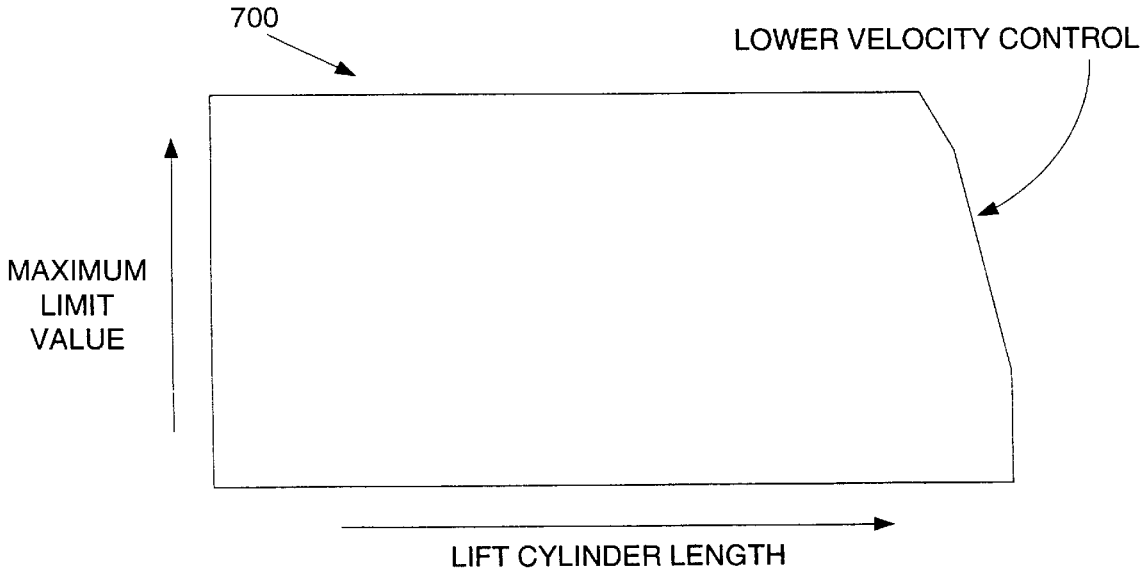
FIG. 7 represents a software look-up table associated with a lowering function.

The present invention additionally provides for a "smooth starting" function during gravity assisted operations, e.g., when the boom is being lowered. Referring now to FIG. 7, the lowering lookup table 700, which controls the lowering of the boom 110, is shown. The lowering look-up table 700 stores a plurality of limiting values that correspond to the position of the lift cylinders 106A,B. The limiting values are chosen to gradually increase the velocity limit of the boom 110 as the boom is lowered from its desired maximum height. Thus, as the boom 110 is lowered from its maximum height, the limiting values gradually increase, which allows the electrical valve signal magnitude to proportionally increase. This provides for greater controllability of the lowering function by preventing "jerky" operation.

Figure 8:
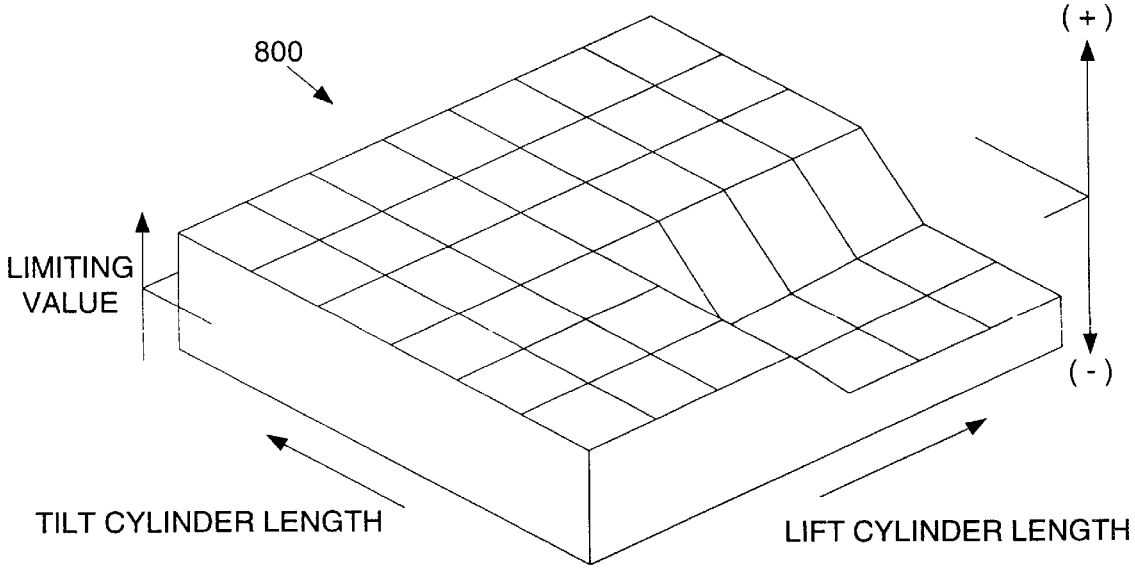
FIG. 8 represents a software look-up table associated with a full rack angle control.

The present invention additionally provides for a full rack angle control. The purpose of the rack angle control is to slightly roll forward a racked bucket as the boom is raised. This automated motion is used to counteract the natural kinematic action of the boom, which increases the backward tilt of the bucket as the boom is lifted. The full rack angle control is embodied in a look-up table, similar to that shown in FIG. 8. The illustrated look-up table 800 stores a plurality of limiting values that correspond to the lift and tilt cylinder positions. The controlling means 208 selects a limiting value in response to the lift and tilt cylinder positions, and compares the limiting value to the operator command signal value. The controller 208 then produces the electrical valve signal with a value equal to the lower of the two compared values. As shown, the lookup table 800 is structured such that positive limiting values are associated with rack commands, and negative limiting values are associated with dump commands, while neutral commands are associated with null limiting values. Thus, the negative limiting values provide for the automated roll forward motion of the control. Note, it may be desirable for the controlling means to only modify the operator command signal while boom is being raised.

Thus, while the present invention has been particularly shown and described with reference to the preferred embodiment above, it will be understood by those skilled in the art that various additional embodiments may be contemplated without departing from the spirit and scope of the present invention.

Industrial Applicability

Earth working machines such as wheel type loaders include work implements capable of being moved through a number of positions during a work cycle. The typical work cycle associated with a bucket includes positioning the boom and bucket in a digging position for filling the bucket with material, a carrying position, a raised position, and a dumping position for removing material from the bucket.

The present invention provides a method and apparatus for progressively and consistently limiting the control of the movement of the implement during a work cycle rather than abruptly stopping or changing the velocity of the implement. Thereby, providing consistent control of rate of motion and stopping position. Such a function is particularly worthwhile to limit the implement movement as it approaches extreme kinematic gain regions.

It should be understood that while the function of the preferred embodiment is described in connection with the boom and associated hydraulic circuits, the present invention is readily adaptable to control the position of implements for other types of earth working machines. For example, the present invention could be employed to control implements on hydraulic excavators, backhoes, and similar machines having hydraulically operated implements.

Other aspects, objects and advantages of the present invention can be obtained from a study of the drawings, the disclosure and the appended claims.

What is claimed is:

1. An apparatus for controllably moving a work implement of an earth moving machine, the work implement including a boom and a bucket being attached thereto, the work implement including a plurality of work functions that includes a lifting and lowering function where the boom is actuated by a hydraulic lift cylinder and dumping and racking function where the bucket is pivoted by a hydraulic tilt cylinder, comprising:

an operator controlled joystick;

a joystick position sensor for sensing the position of the joystick and responsively generating an operator command signal;

an implement position sensor for sensing the elevational position of the boom and the pivotal position of the bucket, and responsively producing respective implement position signals;

a memory storing a look-up table for each work function, the look-up tables including a plurality of values corresponding to a plurality of work implement positions;

controller for receiving the implement position and operator command signals, determining the instant position of the work implement and the corresponding work function, selecting a value from the respective look-up table in response to the respective work implement position, limiting the value of the magnitude of the operator command signal to the lesser of the magnitude of the operator command signal or the value from the respective look-up table, and responsively producing the electrical valve signal having a magnitude equal to the lesser of the magnitude of the operator command signal or the value from the respective look-up table; and a valve for receiving the electrical valve signal, and controllably providing hydraulic fluid flow to the respective hydraulic cylinders in response to a magnitude of the electrical valve signal.

2. A method for controllably moving a work implement of an earth moving machine in response to the position of an operator controlled joystick, the work implement including a boom and a bucket being attached thereto, the work implement including a plurality of work functions that includes a lifting and lowering function where the boom is actuated by a hydraulic lift cylinder and dumping and racking function where the bucket is pivoted by a hydraulic tilt cylinder, comprising the steps of:

sensing the position of the joystick and responsively generating an operator command signal;

sensing the elevational position of the boom and the pivotal position of the bucket, and responsively producing respective implement position signals;

storing a look-up table for each work function, the look-up tables including a plurality of values corresponding to a plurality of work implement positions;

receiving the implement position and operator command signals, determining the instant position of the work implement and the corresponding work function, selecting a value from the respective look-up table in response to the respective work implement position, limiting the value of the magnitude of the operator command signal to the lesser of the magnitude of the operator command signal or the value from the respective look-up table, and responsively producing the electrical valve signal having a magnitude equal to the lesser of the magnitude of the operator command signal or the value from the respective look-up table; and receiving the electrical valve signal, and controllably providing hydraulic fluid flow to the respective hydraulic cylinders in response to a magnitude of the electrical valve signal.

* * * * *